US009650204B2

(12) United States Patent
Buckley et al.

(10) Patent No.: US 9,650,204 B2
(45) Date of Patent: May 16, 2017

(54) EGG PACKAGE

(75) Inventors: Nick Buckley, Watford (GB); Hans Erik Roth, Aabenraa (DK)

(73) Assignee: BRØDRENE HARTMANN A/S, Gentofte (DK)

( * ) Notice: Subject to any disclaimer, the term of this patent is extended or adjusted under 35 U.S.C. 154(b) by 0 days.

(21) Appl. No.: 14/396,176

(22) PCT Filed: May 3, 2012

(86) PCT No.: PCT/IB2012/052216

§ 371 (c)(1),
(2), (4) Date: Oct. 22, 2014

(87) PCT Pub. No.: WO2013/164664

PCT Pub. Date: Nov. 7, 2013

(65) Prior Publication Data

US 2015/0083633 A1 Mar. 26, 2015

(51) Int. Cl.
*B65D 85/32* (2006.01)

(52) U.S. Cl.
CPC ..... *B65D 85/324* (2013.01)

(58) Field of Classification Search
USPC ..... 206/521.1, 521.6, 521.7, 521.8, 521.9
See application file for complete search history.

(56) References Cited

U.S. PATENT DOCUMENTS

| | | | | |
|---|---|---|---|---|
| 1,378,469 | A * | 5/1921 | Koppelman | 217/35 |
| 3,465,947 | A | 9/1969 | Andrews et al. | |
| 7,665,608 | B2 | 2/2010 | Buckley | |
| 2005/0238764 | A1* | 10/2005 | Beese | 426/106 |
| 2005/0274642 | A1* | 12/2005 | Buckley | 206/521.1 |

FOREIGN PATENT DOCUMENTS

| | | |
|---|---|---|
| EP | 1 923 332 | 5/2008 |

* cited by examiner

*Primary Examiner* — J. Gregory Pickett
*Assistant Examiner* — Allan Stevens
(74) *Attorney, Agent, or Firm* — Marvin Petry; Stites & Harbison PLLC

(57) ABSTRACT

An egg package having a bottom part having egg receiving compartments and a cover part hinged to the bottom part. Ends of the cover part each have a pair partially ovoid portions and a concave middle section between them. A continuous curved surface extends from one partially ovoid portion through the concave middle section to the other partially ovoid portion. A substantially planar rim may be located at each end above, in front of and to the rear of the partially ovoid portions. A retaining projection on the bottom part may engage an edge of an aperture in the cover part. A label may cover the outer surfaces of the ends. An interface between the cover part and the bottom part may decline, back to front. The front of the cover part may have a lower downwardly convex edge.

20 Claims, 7 Drawing Sheets

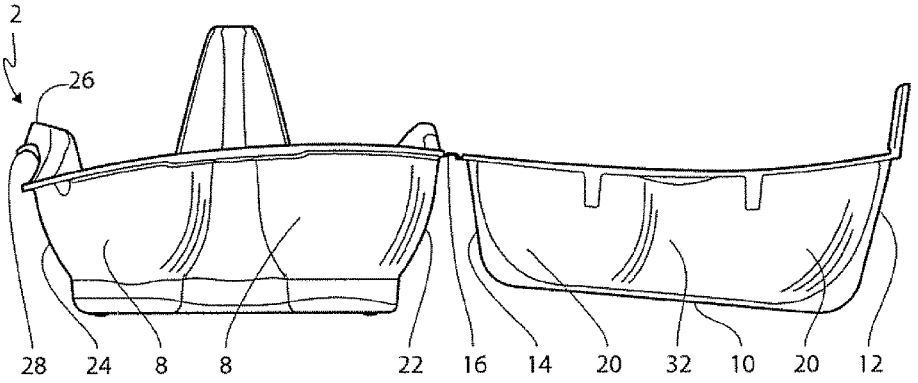
FIG. 5
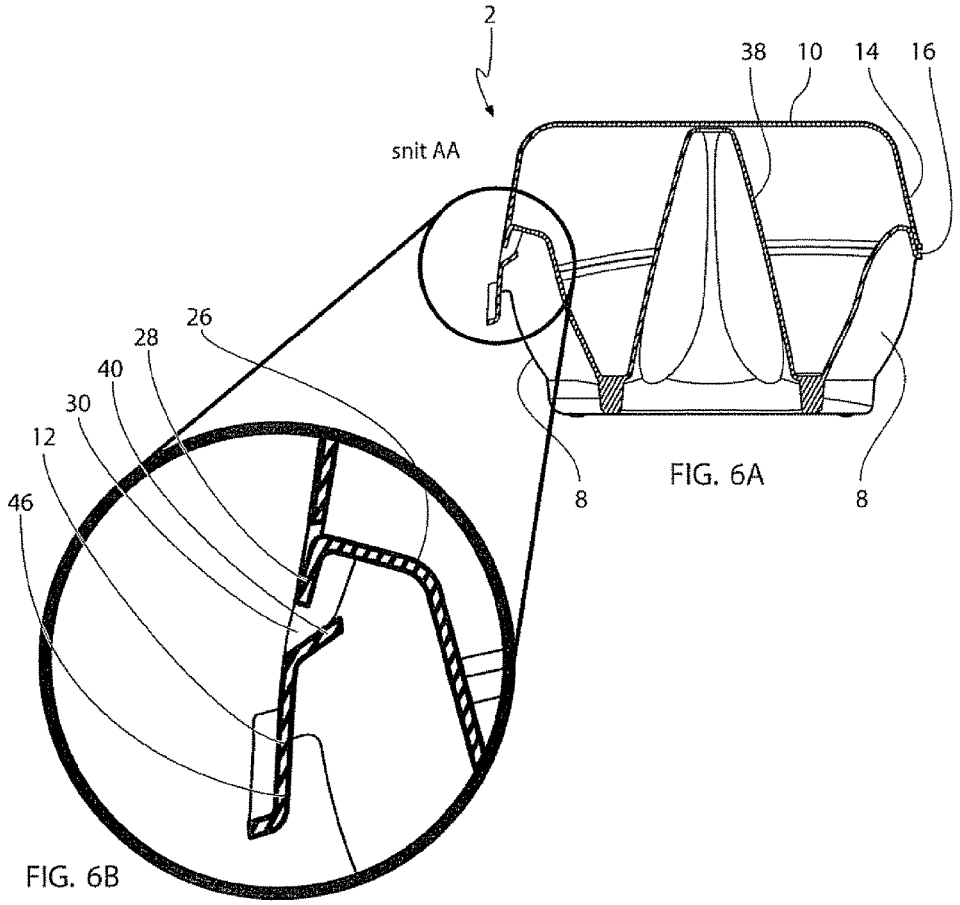
FIG. 6A
FIG. 6B

EGG PACKAGE

TECHNICAL FIELD

The present invention pertains to an egg package.

BACKGROUND OF THE INVENTION

Packages for packing and transporting eggs are known in a variety of forms. Traditionally, such packages have comprised a bottom part provided with suitably shaped compartments for accommodation of the eggs, and an upper part forming a cover over the bottom part for accommodating the upper portions of the eggs housed within the package and for closing the package. Often, the upper part is connected to the lower part by means of a suitable hinge portion, although packages comprising separate bottom and upper parts have also been used. In those packages that comprise a hingedly connected bottom and cover part, the vertical front side of the bottom part is often provided with a flexible flap comprising a number of protrusions for engagement with correspondingly located and shaped holes in the cover part, thereby locking the bottom and cover parts together in the closed state of the package. A package of this kind suffers from various disadvantages. In the closed position, the front face of the package will be subdivided into an upper part and a lower part, and as the lower part is typically formed to be able to accommodate and support the articles contained within the package, it is only the upper part which can be given a planar shape that permits the application of text and pictures describing the contents of the package.

EP 1 373 100 discloses a display and distribution packaging unit for fragile articles, especially for eggs, comprising a bottom part, which at least partially matches the outer contours of the eggs housed within the unit, and a cover part comprising planar top- and side surfaces for the provision of graphical information about the contents of the unit, where portions of the end surfaces of the cover part are shaped to reflect the shape of the eggs housed within the display and distribution package. A problem with this egg package is that the closing and locking mechanism is provided by a traditional locking flap having a protrusion which extends through an aperture in the front side of the cover part, thus reducing the available place for a label.

Thus, in the prior art egg packages it has only been possible to place a label on the top surface of the cover part, which often is not visible when the egg packages are stacked in a sales rack. There has therefore always been a conflict between having a large surface for the placement of a label and at the same time having a reliable closing and locking mechanism, i.e. a large area for a label without compromising the reliability of the locking mechanism. Additionally, a closure flap as known from EP 1 373 100 is an element which increases the cost of manufacture and transport of the egg packages.

Moreover, the separate partially ovoid portions of the above mentioned egg package are not well suitable for being decorated with embossments formed as words or of other more spacious nature.

SUMMARY OF THE INVENTION

It is thus an object of the present invention to provide an egg package which due to its form provides a clear, visible information about the contents of the unit and at the same time offers good opportunities for providing graphical and/or pictorial information on large surfaces of the unit.

It is a further object of the present invention to provide an egg package which may be reliably closed and locked in a substantially error free manner by a machine.

It is a further object of the invention to provide a packaging unit which can be produced as one integrated unit, for instance by suction moulding.

According to the present invention, the above-mentioned and other objects are fulfilled by an egg package formed of a fibrous material, the egg package comprising the following main parts:

- a bottom part comprising a plurality of egg-receiving compartments having non-planar side surfaces so as to match at least partially the outer contours of an egg, the plurality of compartments being arranged in at least two parallel rows,
- a cover part comprising a top surface, a front surface, a back surface, and two planar end surfaces,
- the cover part being permanently connected to the bottom part by a hinge between the back surface of the cover part and the bottom part so as to allow the cover part to move between an open position and a closed position,
- said cover part comprising two partially ovoid portions extending outwardly from each of the two end surfaces, wherein the partially ovoid portions on the same end surface convexly and continuously extend into a continuous and concave middle section, connecting said two partially ovoid portions, said concave middle section together with said two partially ovoid portions being circumvented by a substantially planar rim part bounded by the top surface, front surface and back surface of the cover part.

The packaging unit according to the present invention thus comprises a bottom part provided with one or more compartments for accommodating and supporting the eggs in the packaging unit and a cover part, where one or more portions of the cover part are shaped such that they reflect the shape of the eggs contained within the packaging unit, thereby making the shape of the eggs contained within the unit visible from the outside. By shaping portions of the cover part in this manner, the contents of the packaging unit becomes more apparent than in prior art packaging units, not only when the packaging unit is seen from the side—where both the bottom part and the cover part can be seen—but also when seen from above, in which case the bottom part may be more or less invisible to the viewer.

Moreover, by letting the partially ovoid portions on the same end surface convexly and continuously extend into a continuous and concave middle section, connecting said two partially ovoid portions, said concave middle section together with said two partially ovoid portions being circumvented by a substantially planar rim part bounded by the top surface, front surface and back surface of the cover part, an end portion of the egg package is achieved, wherein it is possible to provide lithographic and/or pictorial information, or even embossments in the form of words, such as slogans. This is due to the fact that the concave surface forms an integral part of the ovoid portions, which therefore is much easier to endow with embossments than the partially ovoid portions of the egg package known in the art and mentioned in the previous paragraph. The substantially planar rim part ovoid portions and concave middle section in essence constitute the end surface of the cover part.

According to the invention, said cover part and said bottom part can be moulded as one integrated unit by suction moulding.

It should be noted that throughout this description and the appended claims the expression 'partial ovoid portions' should be understood as a portion having a shape that provides a viewer with a clear association of the form of an egg without necessarily having a form exactly corresponding to an egg. Accordingly, surfaces or sub-surfaces of a number of different solids of revolution, for instance of an ellipsoid, may reflect the shape of an egg within this context.

According to one embodiment of the invention, the bottom part comprises a back side, a front side, two end sides, and at least one upwardly extending retainment projection extending from the front side of the bottom part, the upwardly extending retainment projection having a downwardly and outwardly extending retainment flap for locking engagement with one or more co-operating apertures in the front surface of the cover part, the retainment flap not extending beyond the front surface of the cover part when the cover part is in its closed position.

Hereby, a reliable and stable locking function that may be facilitated by simple mechanical closing means is achieved, for example provided by packing machinery, without the risk of damaging the fragile eggs being placed in the package. This is due to the fact that the egg package according to the above embodiment may be closed and locked in one operation by pivoting the cover part in relation to the hinge. This pivoting of the cover part may thus be facilitated by only one mechanical operation by the packing machinery. Typically, packaging machinery is adapted for handling a tremendous number of packages over a short time span. It is therefore an important advantage of the present embodiment that the package can be closed and locked in an error free and reliable manner by the packaging machinery. Since, the retainment flap(s) are projecting downwardly and outwardly, the cooperating aperture(s) on the cover part can slide over the retainment flap(s) during closing of the egg package and engage it in a locking manner because the retainment flap(s) will simply work as a hook which hooks onto a lower edge of the aperture. This way a simple—yet effective—way of providing reliable locking means on the cover part is achieved, which furthermore is easy to manufacture. Preferably, there is a number of such apertures which corresponds to the number of retainment flaps.

Since, the retainment flaps do not extend beyond the front surface of the cover part when the cover part is in its closed position, it is possible to equip the cover part with a label covering the top surface and the entire front surface of the cover part.

Accordingly, it is seen that the claimed locking mechanism and the new end portions of the end surfaces provide the synergetic effect by which all technical locking features are hidden beneath the label, thus providing an egg package that, due to its form, provides a clear, visible information about the contents of the unit and at the same time offers good opportunities for providing graphical and/or pictorial information on remaining surfaces of the cover part.

According to a further embodiment, the cover part is provided with a label covering the top surface and a substantial part of the front surface of the cover part. Consumer investigations have shown that a label does not provide enough sales appeal. However, if in addition to labels, the egg package is distinguished by its form as well, it provides a greater appeal to a consumer. Egg packages have more or less looked the same during the last decades. Thus, by the provision of an egg package of the kind described above, wherein a label is placed over the top surface of the cover part and a substantial part of the front surface of the cover part, and which is provided with the partially ovoid portions and a concave middle section on the end surfaces of the cover part, a very consumer appealing egg package is provided, because there are no disrupting features (e.g. the locking mechanism) which may interfere with the impression the package will give the consumer. This simplicity and "cleanness" of the egg package will furthermore make it more easily recognizable for a consumer.

According to one preferred embodiment, the cover part comprises a tongue that extends upwardly and inwardly from the lower edge of the one or more apertures, said lower edge of the one or more apertures being substantially flush with the front surface of the cover part, said tongue being adapted for cooperating with the outwardly and downwardly extending retainment flap. Hereby is achieved a simple—yet effective—locking mechanism wherein the egg package can be closed and locked by a single mechanical operation of a packaging machinery because, when the package is being closed, the inwardly and upwardly extending tongue will slide over the outwardly and downwardly extending retainment flap. During this sliding, the retainment flap and tongue will bend slightly and then relax back to the normal position when they slide pass each other due to the slight resilience of the fibrous material.

According to another preferred embodiment of the egg package according to the invention, any of the partially ovoid portions of the cover part and/or any of the two middle sections may be provided with an embossment. This embossment could for example be customized and individual for each egg producer, and may comprise words and/or ornamental features. Since the partially ovoid portions extend into a concave—or at least partially concave—and coherent middle section, there is a rather large area in the end portions of the cover part wherein this embossment can be placed, thus giving an enhanced possibility for the individual egg producer to distinguish his/her products.

According to a further preferred embodiment, of the egg package according to the invention, the embossment extends outwardly from any of the partially ovoid portions and/or any of the two middle sections. Hereby is achieved an enhanced visibility of the embossment and thereby an enhanced intelligibility and readability of said embossment in those cases where said embossment comprises words. Said embossment is preferably formed in an after press operation on the inner side of the cover part.

According to a further preferred embodiment, the partial ovoid portions in the cover part are about one quarter of a complete ovoid. This gives a distinct and clear information to a consumer that this particular package contain eggs.

In another preferred embodiment, the partial ovoid portions of the cover part continue in the corresponding egg-receiving compartments in the bottom part, the corresponding portions in the cover part and in the bottom part thereby matching a continuous portion of a surface of an egg. Providing not only the cover part with portions reflecting the shape of the eggs in the unit, but also shaping the corresponding portions of the bottom part so that they reflect the shape of the eggs, further enhances the visual information about the contents of the unit. The individual portions of the cover part and the corresponding portions of the bottom part may in the closed state of the unit merge into a substantially continuous surface, reflecting a relatively large portion of the surface of an egg.

Preferably, the surface structure of the partial ovoid portions, including the concave middle section, is different than the surface structure of the remaining portions of the cover part. By providing those portions of the cover part, which reflect the contents of the unit, with a surface structure differing from the surface structure of the remaining portions of the cover part, the contents of the packaging unit is made even more apparent as seen from the outside, for instance by a customer in a store.

For example the surface structure of the partial ovoid portions and concave middle section is relatively smooth, while the surface structure of the remaining surfaces of the package is relatively coarse, or alternatively the surface structure of the partial ovoid portions and the concave middle section is relatively coarse, while the surface structure of the remaining surfaces of the package is relatively smooth.

In one preferred embodiment, the interface between the cover part and bottom part inclines downwardly from the rear side of the package to the front side, thus yielding a higher front surface of the cover part than back surface of the cover part, thus yielding a higher front side of the cover part than rear side of the cover part, the higher front side thereby providing more space for the attachment of labels, etc. On opening the cover part of the filled packaging unit, a larger part of the eggs contained in the unit thus becomes visible from the front side of the unit, which is normally the side of the unit facing the customer in a store. This provides for a better opportunity to inspect the eggs in the unit, for instance for possible damages hereof, and has the further effect that the eggs in the unit appear larger. The interface between the cover part and bottom part is preferably curved.

The lower edge of the front surface of the cover part is preferably curved in a downward direction beneath an interface between the cover part and bottom part for extension of the area of the front surface and for facilitating the opening of the egg package. This is done in order to provide a better grip of the edge portion of the cover part for opening the unit—and also in order to further increase the area of the front surface of the cover part and hence the possibility to attach labels, etc to this portion of the cover part. For example, the lower edge of the front surface may according to the invention be extended in a downwards direction, past the interface between the cover part and the bottom part. The downward extension of the front surface of the cover part may in some embodiments cover up to the total height of the bottom part.

In a further embodiment, the lower edge of the front surface of the cover part is formed as an arc of a circle. This curved, organic shape is very appealing to a consumer. Furthermore, egg packages manufactured by suction moulding of a fibrous material are easier to handle in the production line if they are provided with rounded or curved lines.

In order to enhance the locking engagement between the retainment flaps and the corresponding cooperating apertures in the cover part, the egg package may according to a preferred embodiment be so constructed that the lower part of the front surface of the cover part bulges inwardly. Such an inwardly bulging lower part of the front surface of the cover part will—due to the slight resilience of the pulp material—slide over the upwardly extending retainment projections, which will force the front surface to bulge outwardly in such a manner that it will slide over these projections in an abutting manner until the apertures in the cover part will slide over the retainment flaps, and therefore provide a more reliable locking engagement between the cover part and the bottom part.

In a preferred embodiment the cover part may comprise a rim portion extending outwardly from the cover part. This rim portion may function as a gripping area for automated de-nesting machinery, which is used in most egg packaging facilities.

In most countries there is a legal requirement that egg packages must be provided with technical information about the eggs, such as farming conditions, origin, nutritional information, etc. Thus, according to a preferred embodiment of the invention, the inner side of the top surface of the cover part comprises a substantially flat, and preferably also rectangular, info area, onto which technical details about the eggs are provided. Hereby it is achieved that such technical information is not directly visible from outside a closed egg package, and that such information therefore cannot interfere with the label and brand that the producer wants to convey to the consumer.

According to a preferred embodiment, the egg package is formed by suction moulding of a fibrous material, such as moulded pulp. Preferably, the pulp is mixed with wax. It has surprisingly been found that a substantially waterproof egg package can be achieved if wax is used. When the newly formed egg packages are after pressed, then the wax will bond the fibers together in such a way that a substantially waterproof egg package is achieved, and the wax will act as a water seal, thereby giving the egg package a substantially water repellant surface.

Advantageously, the bottom part may comprise a rim portion extending outward from the bottom part.

The cover of an egg package of the above-mentioned kind, i.e. one that is made of a fibrous material, is usually too soft to support layers of additional egg packages filled with eggs on top of each other, for example in a sales rack. Without at least one upwardly extending projection located between the rows of egg receiving compartments to support the cover when the egg package is closed, the weight of the additional egg filled egg packages will rest on the eggs of the lower packages in the stack, which may then break during storage and transport. Thus, according to a preferred embodiment of the invention, the inner side of the top surface of the cover part rests on the top of said upwardly extending projections of the bottom part when the cover part is in the closed position.

BRIEF DESCRIPTION OF THE DRAWINGS

A further understanding of the nature and advantages of the present invention may be realized by reference to the remaining portions of the specification and the drawings. In the following, preferred embodiments of the invention are explained in more detail with reference to the drawings, wherein FIG. 5 shows an end view of an embodiment of an open egg package, FIG. 6A-6B illustrates the closing mechanism of an embodiment of an egg package.

DETAILED DESCRIPTION

Figure 1:
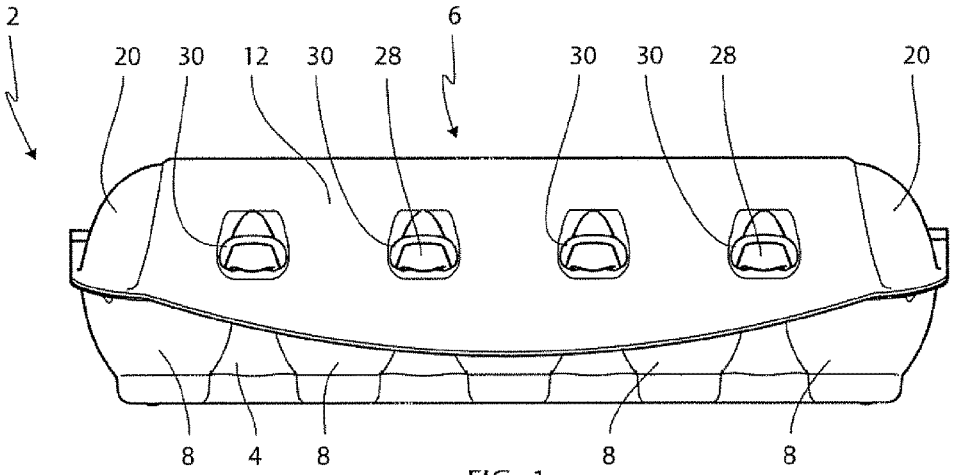
FIG. 1 shows a front view of an embodiment of an egg package according to the invention.

The present invention will now be described more fully hereinafter with reference to the accompanying drawings, in which exemplary embodiments of the invention are shown. The invention may however be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout. Like elements will thus not be described in detail with respect to the description of each figure.

FIG. 1-4 show an embodiment of an egg package 2 according to the invention as seen from different perspectives. The package 2 is formed of a fibrous and opaque material. The illustrated package 2 is shown in its closed position, and it comprises a bottom part 4 comprising a plurality of egg-receiving compartments 8 having non-planar side surfaces so as to match at least partially the outer contours of an egg, the plurality of compartments 8 being arranged in two parallel rows.

Figure 3:
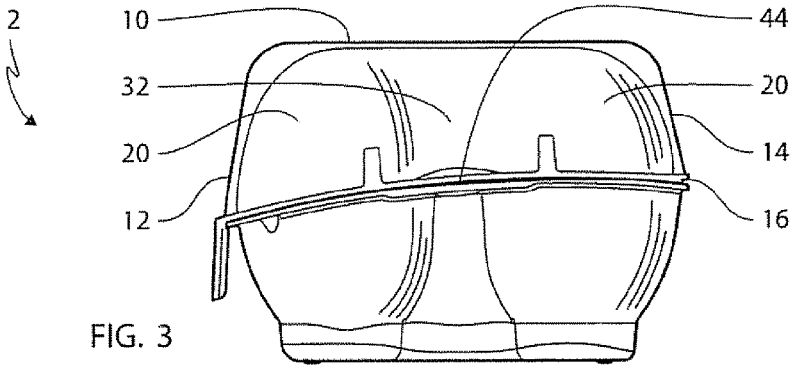
FIG. 3 shows an end view of an embodiment of an egg package according to the invention.

As can be seen more clearly in FIG. 3, the cover part 6 comprises a top surface 10, a front surface 12, and a back surface 14. The cover part 6 is permanently connected to the bottom part 4 by a hinge 16 between the back surface 14 of the cover part 6 and the bottom part 4 so as to allow the cover part 6 to move between an open position and a closed position.

Figure 2:
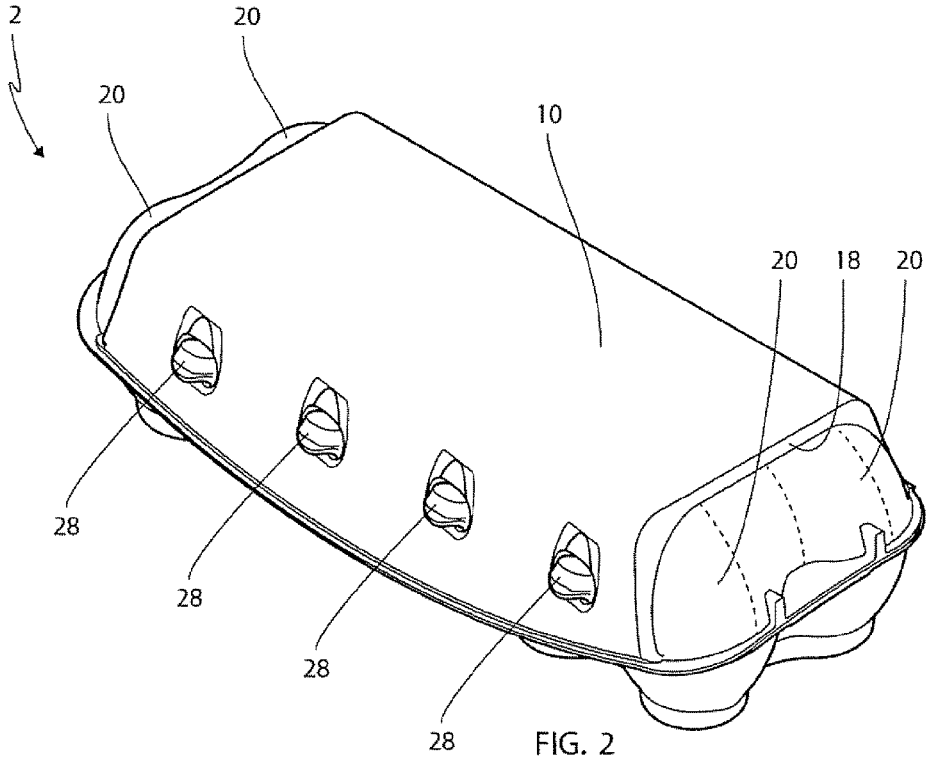
FIG. 2 shows a perspective view of an embodiment of an egg package according to the invention.
Figure 4:
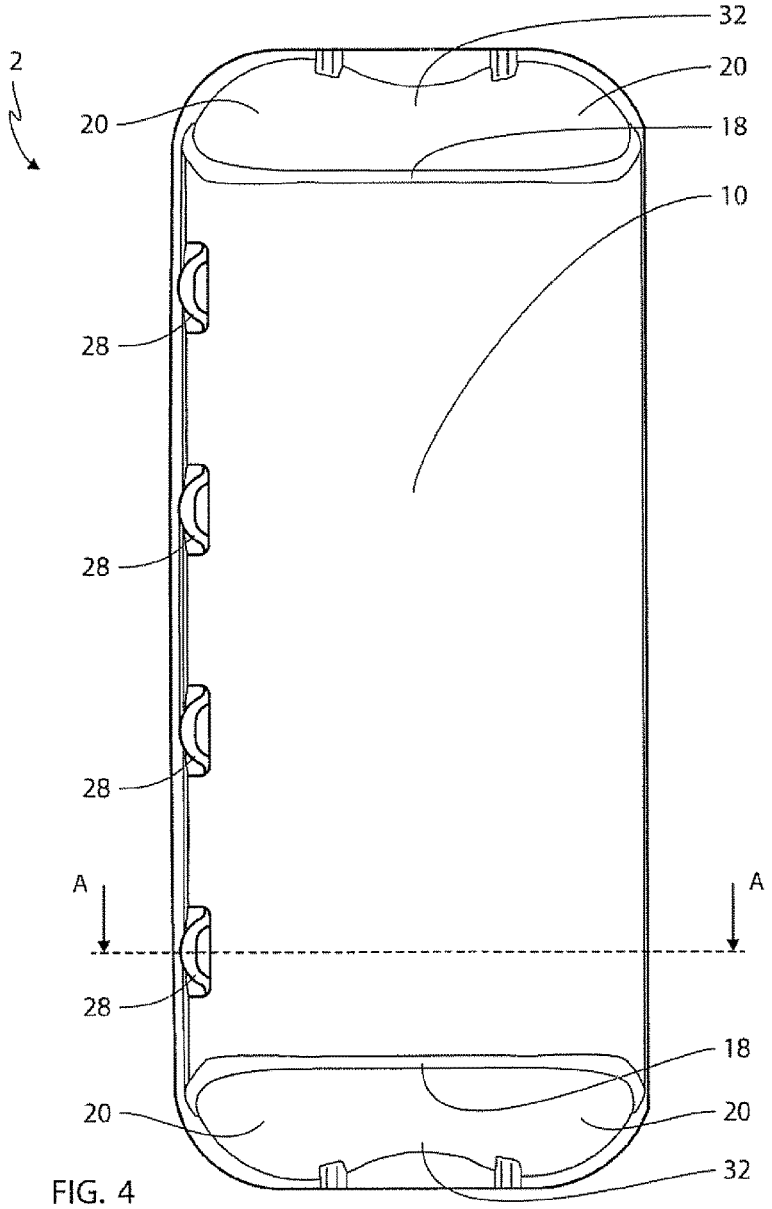
FIG. 4 shows an egg package according to the invention, seen from above.

As can be seen more clearly in FIG. 2 and FIG. 4, the cover part also comprises two end surfaces. Referring now to FIG. 1-4, it is seen that the cover part 6 furthermore comprises partial ovoid portions 20, also referred to as egg-shaped portions, extending outwardly from the two end surfaces to an outermost part, and wherein the partially ovoid portions curve upwardly continuously from the interface to the top of the partially ovoid portions, wherein the partially ovoid portions 20 on the same end surface convexly and continuously extend into a continuous and concave middle section 32 connecting said two partially ovoid portions 20, said concave middle section 32 and the two partially ovoid portions 20 being circumvented by a substantially planar rim part 18, which is bounded by the top surface 10, front surface 12 and back surface 14 of the cover part 6. As seen in all of the figures, the partial ovoid portions, being egg shaped, have a curvature which increases from the interface to the top thereof. In essence the concave middle section 32 and the two ovoid portions 20, together with the substantially planar rim part 18, form an end surface of the cover part 6. As seen in FIGS. 2-5 and 7-11, the continuous and concave middle section 32 has a curvature in the horizontal direction which decreases gradually from the interface to the top of the partially ovoid portions.

FIG. 5 shows the same embodiment of an egg package as shown in FIG. 1-4, but here in an end-view and in the open position. In FIG. 5 it is shown that the bottom part 4 comprises a back side 22 and a front side 24 (and two end sides, which are not illustrated). Also shown in FIG. 5 is an upwardly extending retainment projection 26 extending from the front side 24 of the bottom part 4. The upwardly extending retainment projection 26 has a downwardly and outwardly extending retainment flap 28 for locking engagement with one or more co-operating apertures 30 in the front surface 12 of the cover part 6 (see for example FIG. 1 for a better view of the apertures). The retainment flap 28 is configured for not extending beyond the front surface 12 of the cover part 6 when the cover part 6 is in its closed position.

FIG. 6A shows a cross section of the egg package 2 illustrated in FIG. 1-5. The cover part 6 of an egg package 2 of the above-mentioned kind, i.e. one that is made of a fibrous material, is usually too soft to support layers of additional egg packages 2 filled with eggs on top of each other, for example in a sales rack. Without at least one upwardly extending projection 38 located between the rows of egg receiving compartments 8 to support the cover part 6 when the egg package is closed, the weight of the additional egg filled egg packages will rest on the eggs of the lower packages in the stack, which may then break during storage and transport. Thus, according to a preferred embodiment, the inner side of the top surface 10 of the cover part 6 rests on the top of said upwardly extending projections 38 of the bottom part 4 when the cover part 6 is in the closed position.

In the close-up FIG. 6B is illustrated a cover part 6, which comprises a tongue 40 which extends upwardly and inwardly from the lower edge of the one or more apertures 30, said lower edge of the one or more apertures being substantially flush with the front surface 10 of the cover part 6, said tongue 40 being adapted for cooperating with the outwardly and downwardly extending retainment flap 28. Hereby is achieved a simple—yet effective—locking mechanism, wherein the egg package 2 can be closed and locked by a single mechanical operation of a packaging machinery, because when the package 2 is being closed, the inwardly and upwardly extending tongue 40 will slide over the outwardly and downwardly extending retainment flap 28. During this sliding, the retainment flap 28 and tongue 40 will bend slightly, and then relax back to the normal position when they slide pass each other—due to the slight resilience of the fibrous material. The illustrated part of the front surface 12 of the cover part 6 is equipped with a label 42, covering all the locking mechanism of the egg package 2. When a user needs to open the package 2, he/she only needs to pull outwardly in the lower edge 46 of the front surface 12.

Figure 7:
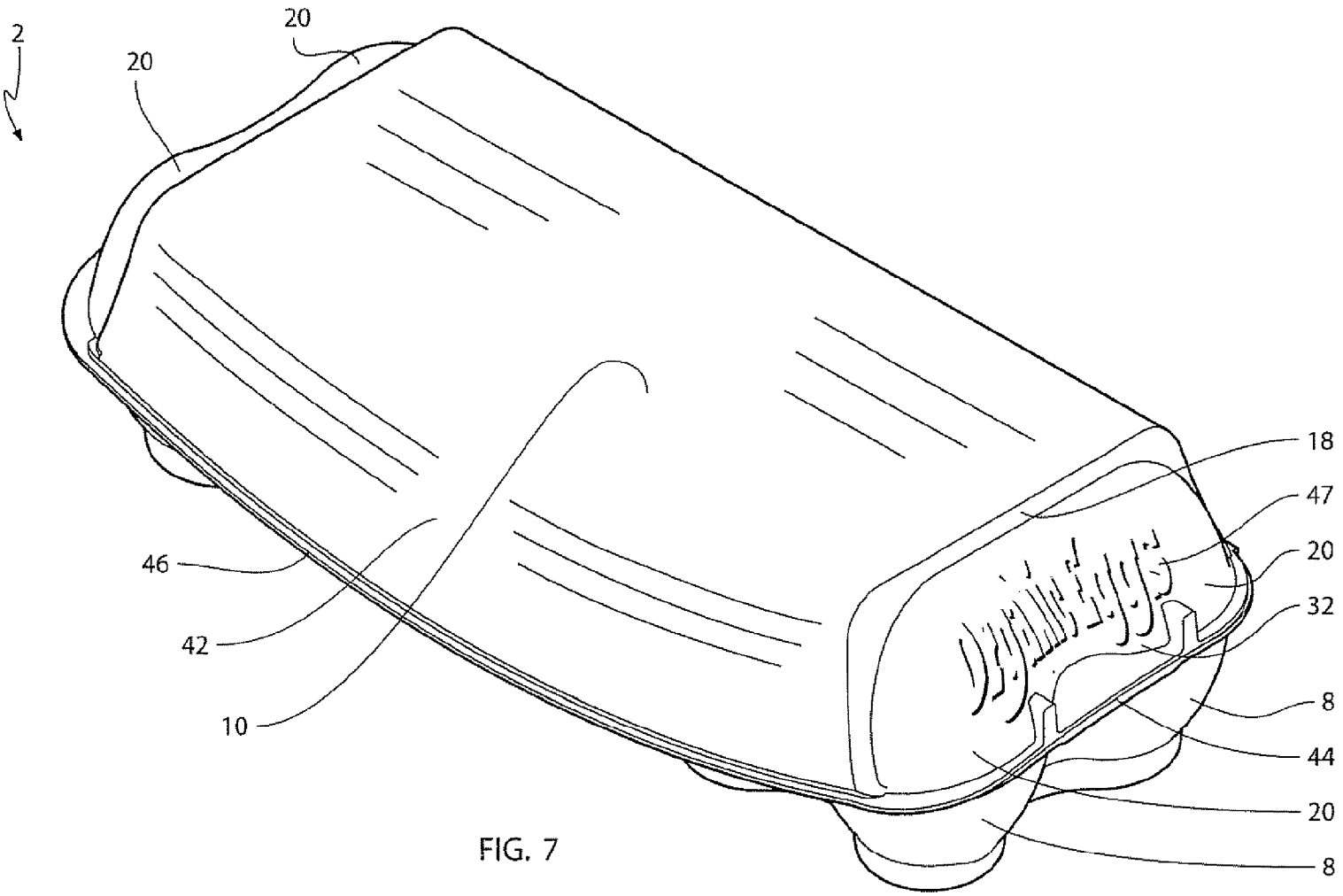
FIG. 7 shows a perspective view of an embodiment of an egg package according to the invention provided with a label.

FIG. 7 shows a perspective view of the egg package 2, wherein the cover part 6 is provided with a label 42 covering the top surface 10 and the entire front surface 12 of the cover part 6, whereby all the technical features of the locking mechanism are hidden by the label, thereby giving the unit a clean and smooth appearance. The partial ovoid portions 20 in the cover part 6 are about one quarter of a complete ovoid. This gives distinct and clear information to a consumer that this particular package 2 contains eggs.

As illustrated, the partial ovoid portions 20 of the cover part 6 continue in the corresponding egg-receiving compartments 8 in the bottom part 4, the corresponding ovoid portions 20 in the cover part 6 and in the bottom part 4 thereby matching a continuous portion of a surface of an egg. Providing not only the cover part 6 with portions reflecting the shape of the eggs in the unit, but also shaping the corresponding portions 8 of the bottom part 4 such that they reflect the shape of the eggs, further enhances the visual information about the contents of the unit. The individual ovoid portions 20 of the cover part 6 and the corresponding portions 8 of the bottom part 4 may in the closed state of the unit merge into a substantially continuous surface reflecting a relatively large portion of the surface of an egg.

The partial ovoid portions 20 together with the corresponding egg-receiving compartments 8 in the bottom part 5 constitutes at least approximately 60% of the total surface of an egg. Hereby, the eggs are supported in a manner which reduces the risk of damage of the eggs caused by the accelerations experienced for instance during vibrations of the package 2, and if the package 2 is accidentally dropped. Specifically, said compartments 8 can also be formed to support the eggs at the bottom portion of the compartments 8.

In some embodiments, the surface structure of the partial ovoid portions 20 and the concave middle section 32 is different than the surface structure of the remaining portions of the cover part 6. By providing those portions of the cover part 6, which reflect the contents of the package 2, with a surface structure differing from the surface structure of the remaining portions of the cover part 6, the contents of the package 2 is made even more apparent as seen from the outside, for instance by a customer in a store.

For example the surface structure of the partial ovoid portions 20 and the concave middle section 32 may be relatively smooth, while the surface structure of the remaining surfaces of the package 2 may be relatively coarse, or alternatively the surface structure of the partial ovoid portions 20 and the concave middle section 32 may be relatively coarse, while the surface structure of the remaining surfaces of the package 2 is relatively smooth.

As illustrated in FIG. 7, and more clearly in FIG. 3, the interface 44 between the cover part 6 and bottom part 4 inclines downwardly from the rear side of the package 2 to the front side, thus yielding a higher front surface 12 of the cover part 6 than back surface 14 of the cover part 6, the higher front surface 12 thereby providing more space for the attachment of labels 42, etc. On opening the cover part 6 of the filled package 2, a larger part of the eggs contained in the unit thus becomes visible from the front side of the package 2, which is normally the side of the package facing the customer in a store. This provides for a better opportunity to inspect the eggs in the unit, for instance for possible damage hereof, and has the further effect that the eggs in the package 2 appear larger. The interface between the cover part 6 and bottom part 4 is preferably curved.

The lower edge 46 of the front surface of the cover part is preferably curved in a downward direction beneath an interface 44 between the cover part 6 and bottom part 4 for extension of the area of the front surface 12 and for facilitating the opening of the unit. This is done in order to provide a better grip of the edge portion 46 of the cover part 6 for opening the package 2, and also in order to further increase the area of the front surface 12 of the cover part 6 and hence the possibility to attach labels 42, etc. to this portion of the cover part 6. For example, the lower edge 46 of the front surface 6 may according to the invention be extended in a downward direction, past the interface 44 between the cover part 6 and the bottom part 4. The downward extension of the front surface 12 of the cover part 6 may in some (not illustrated embodiments) cover up to the total height of the bottom part 4.

In order to enhance the locking engagement between the retainment flaps 28 and the corresponding cooperating apertures 30 in the cover part, the egg package 2 may according to a preferred embodiment be so constructed that the lower part 46 of the front surface 12 of the cover part 6 bulges slightly inwardly. Such an inwardly bulging lower part 46 of the front surface 12 of the cover part 6 will, due to the slight resilience of the pulp material, slide over the upwardly extending retainment projections 26, which will force the front surface 12 to bulge outwardly in such a manner that it will slide over these projections 26 in an abutting manner until the apertures in the cover part slides over the retainment flaps 28, and therefore provide a more reliable locking engagement between the cover part 6 and the bottom part 4.

The egg package 2 is preferably formed by suction moulding of the fibrous material, which is preferably pulp.

As can be seen from the egg package 2 illustrated in FIG. 7, one of the partially ovoid portions 20 of the cover part 6 and the middle sections 32 is provided with an embossment 47. The embossment 47 extends outwardly form one of the partially ovoid portions 20 and the middle section 32. Said embossment is preferably a text and/or an ornament.

Figure 8:
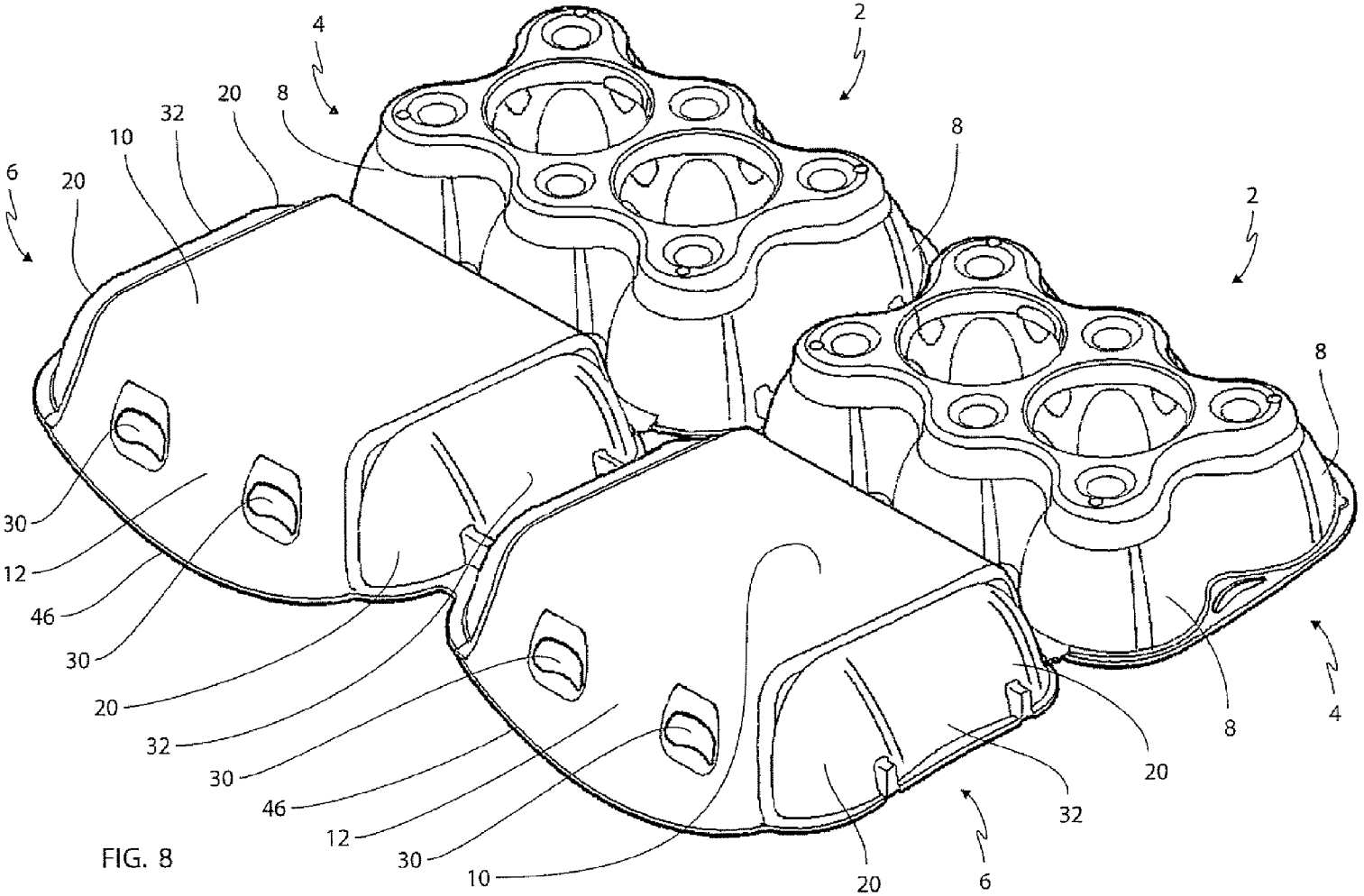
FIG. 8 shows a bottom view of an embodiment of two open 6-packs

FIG. 8 shows a bottom view of an embodiment of two open egg packages 2, which are adapted for accommodating 6 eggs each. The illustrated egg packages have most features in common with the egg package illustrated in FIG. 1-7, which therefore need not be described in detail for this embodiment. In the illustrated egg packages 2 (the 6-packs), the lower edge 46 of the front surface 12 of the cover part 6 is formed as an arc of a circle.

The two egg packages 2 are moulded in one piece, in which they are interconnected along the rim portion and de-nester projections at one end side of each egg package 2. When packaging eggs, i.e. when filling the packages 2 with eggs in a packaging machine, the two packages 2 are not separated from each other, but usually continue throughout the packaging machinery together, and are not separated from each other before arriving at the supermarket.

Figure 9:
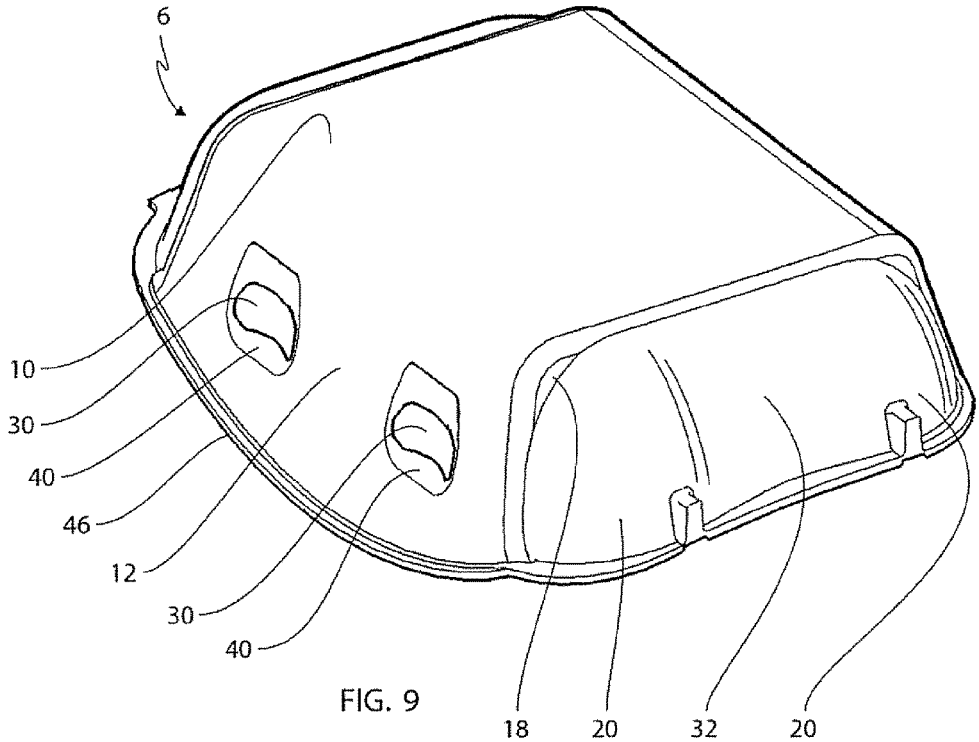
FIG. 9 shows a close-up view of an embodiment of a cover part.

FIG. 9 shows a close-up view of an embodiment of a cover part 6. In this view the substantially flat end surface 18 of the cover part 6 is clearly visible. As illustrated, the two partially ovoid portions 20 continuously extend into a concave middle section 32, thereby giving an immediate impression of the contents of the package 2, while at the same time providing a fairly large continuous surface (the ovoid portions 20 together with the middle section 32), which can be provided with a fairly large and conspicuous embossment, such as a word mark and/or figure mark. This embossment (not shown) could in one embodiment be customized. Hereby any given egg producer will be able to distinguish his/her products from the other products in the market.

Figure 10:
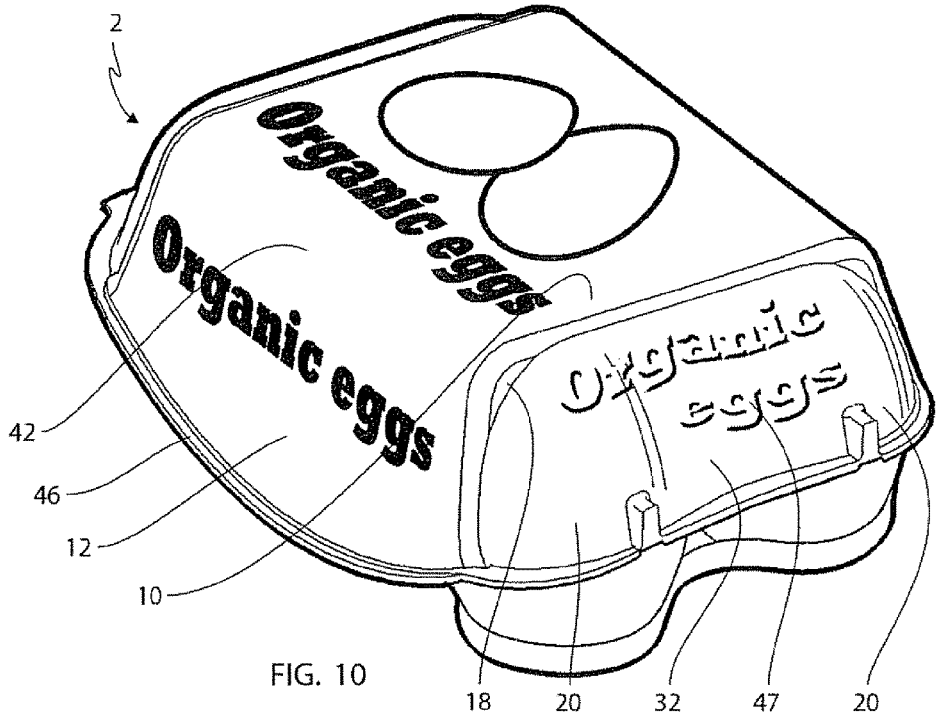
FIG. 10 shows an embodiment of a 6-pack provided with a label and with the cover part in its closed position.

FIG. 10 shows an embodiment of an egg package 2 provided with a label 42, and with the cover part 6 in its closed position. The illustrated egg package 2 is for accommodating six eggs, and due to the fact that the outwardly and downwardly extending retainment flap 28 is not extending beyond the front side 12 of the cover part 6, it is possible to provide the cover part 6 with a label covering all the front surface 12 and top surface 10 of the cover part, thus giving a huge area for textual and pictorial information, which in the illustrated example is a picture of two eggs and a text message informing the consumer that the contents of said egg package 2 is organic eggs, i.e. eggs from hens who are fed by organically produced foodstuff. The partially ovoid portions 20 and concave middle section 32 are provided with an outwardly projecting embossment 47 in the form of a text message, which is more conspicuous than plane text, and therefore provides the consumer with information about the contents of the egg package 2, i.e. that the contents are organic eggs, even in those situations, where the egg package 2 is only visible from the end side.

Figure 11:
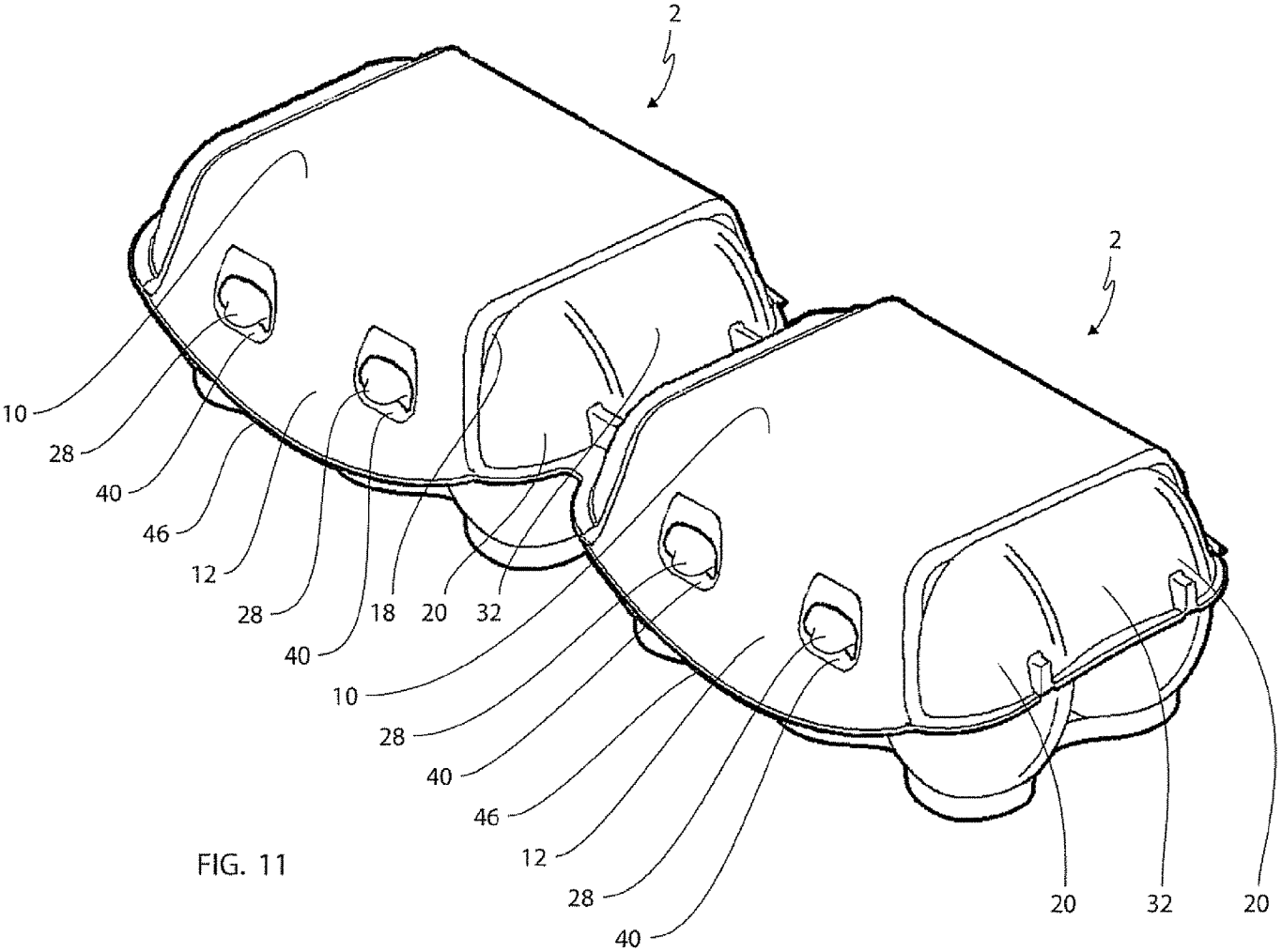
FIG. 11 shows a perspective view of an embodiment of two interconnected 6-packs with the cover part in the closed position.

FIG. 11 shows a perspective view of an embodiment of two interconnected egg packages 2 (6-packs) with the cover part 6 in the closed position.

LIST OF REFERENCE NUMBERS

In the following is given a list of reference numbers which are used in the detailed description of the invention.

2 egg package,
4 bottom part,
6 cover part,
8 egg-receiving compartments,
10 top surface of the cover part,
12 front surface of the cover part,
14 back surface of the cover part,
16 hinge,
18 substantially planar rim part,
20 partially ovoid portions,
22 back side of bottom part,
24 front side of bottom part,
26 upwardly extending retainment projection,
28 outwardly and downwardly extending retainment flap,
30 apertures in the front surface of the cover part,
32 concave middle section,
38 upwardly extending projections of the cover part,
40 upwardly and inwardly extending retainment tongue in the cover part,
42 label,
44 interface between the cover part and the bottom part,
46 lower edge of the front surface of the cover part, and
47 embossment

The invention claimed is:

1. An egg package formed of a fibrous material, comprising:

a bottom part comprising a plurality of egg-receiving compartments, each having non-planar side surfaces of an ovoid shape, the plurality of compartments being arranged in at least two parallel rows, a cover part comprising a top, a front, a back and two ends, the cover part being hingedly connected to the bottom part between the back of the cover part and a back of the bottom part so as to allow the cover part to move between an open position and a closed position, the cover part and the bottom part meeting along the front and both ends at an interface, the cover part comprising two partially ovoid portions extending outwardly from each of the two ends to an outermost part, the partially ovoid portions being egg-shaped, with a curvature which increases continuously from the interface to tops of the partially ovoid portions and a middle section between the two partially ovoid portions, the middle section being concave, seen in horizontal cross-sections, a depth of which concavity gradually reduces upwardly from a given depth at the interface to a straight line at a height of the tops of the partially ovoid portions, such that the concave middle section, seen in vertical cross-sections, curves convexly continuously upwardly and inwardly.

2. The egg package according to claim 1, said concave middle sections together with said two partially ovoid portions being bounded by a substantially planar rim on a top, a front and a back of the ends.

3. The egg package according to claim 2, wherein the bottom part comprises at least one retainment projection which extends upwardly from a front of the bottom part and then outwardly and downwardly to form a retainment flap for locking engagement with one or more apertures in the front of the cover part.

4. The egg package according to claim 3, wherein the cover part comprises a tongue that extends upwardly and inwardly from a lower edge of one or more of said apertures, said lower edge of one or more apertures being substantially flush with a front surface of the cover part, said tongue cooperating with the outwardly and downwardly extending retainment flap.

5. The egg package according to claim 1, wherein the cover part is provided with a label covering an outer surface of the top and a part of the front of the cover part.

6. The egg package according to claim 1, wherein at least one of the partially ovoid portions of the cover part and/or at least one of the concave middle sections is provided with embossments.

7. The egg package according to claim 1, wherein a surface structure of the partially ovoid portions are different than a surface structure of a remaining portion of the cover part.

8. The egg package according to claim 1, wherein the interface between the cover part and the bottom part declines from a back of the package to a front of the package, thus yielding a greater height of the front of the cover part than a height of the back of the cover part.

9. The egg package according to claim 8, wherein the interface is curved.

10. The egg package according to claim 1, wherein a lower edge of the front of the cover part is curved convexly in a downward direction to a point lower than the interface between the front of the cover part and a front of the bottom part to enlarge an area of the front of the cover part and to facilitate opening the egg package.

11. The egg package according to claim 10, wherein the lower edge of the front of the cover part is formed as a downwardly convex arc of a circle.

12. The egg package according to claim 1, wherein the fibrous material includes wax.

13. The egg package according to claim 1, wherein the fibrous material is mixed with a water proofing agent.

14. An egg package formed of a fibrous material, comprising:

a bottom part comprising a plurality of egg-receiving compartments, a cover part comprising a top, a front, a back and two ends, each end including a generally planar rim adjacent the front, top and back of the cover part, the cover part and the bottom part meeting along the front and both ends at an interface, the cover part comprising two partially ovoid portions extending outwardly from each of the two ends to an outermost part, the partially ovoid portions being egg-shaped, with a curvature which increases continuously from the interface to tops of the partially ovoid portions, and a middle section between the two partially ovoid portions, the middle section being concave, seen in horizontal cross-sections, a depth of which concavity gradually reduces upwardly from a given depth at the interface to a straight line at the rim, such that the concave middle section, seen in vertical cross-sections, curves convexly continuously upwardly and inwardly from the interface to the rim.

15. The package according to claim 14, wherein the bottom part comprises the plurality of egg receiving compartments, each having non-planar side surfaces of an ovoid shape, and the plurality of compartments being arranged in at least two parallel rows.

16. The egg package according to claim 15, wherein the cover part comprises the top, the front, the back and two ends, the cover part being connected to the bottom part between the back of the cover part and a back of the bottom part as to allow the cover part to hinge between an open position and a closed position.

17. The egg package according to claim 14, wherein at least one of the partially ovoid portions of the cover part and/or the middle concave section is provided with embossments.

18. The egg package according to claim 14, wherein the cove part is provided with a label covering the front of the cover part.

19. The egg package according to claim 14, wherein the interface declines at the ends from a back of the package to a front of the package, thus yielding a greater height of the front of the cover part than a height of the back of the cover part.

20. The egg package according to claim 14, wherein a lower edge of the front of the cover part is curved convexly downwardly to a point lower than the interface between the front of the cover part and a front of the bottom part to enlarge an area of the front of the cover part and to facilitate opening of the egg package.

* * * * *